US008955329B2

(12) United States Patent
Popovic et al.

(10) Patent No.: US 8,955,329 B2
(45) Date of Patent: Feb. 17, 2015

(54) DIFFUSION NOZZLES FOR LOW-OXYGEN FUEL NOZZLE ASSEMBLY AND METHOD

(75) Inventors: Predrag Popovic, Greenville, SC (US); Abinash Baruah, Assam (IN)

(73) Assignee: General Electric Company, Schenectady, NY (US)

( * ) Notice: Subject to any disclaimer, the term of this patent is extended or adjusted under 35 U.S.C. 154(b) by 747 days.

(21) Appl. No.: 13/278,960

(22) Filed: Oct. 21, 2011

(65) Prior Publication Data

US 2013/0098048 A1 Apr. 25, 2013

(51) Int. Cl.
*F23R 3/28* (2006.01)
*F23D 14/24* (2006.01)

(52) U.S. Cl.
CPC .. *F23D 14/24* (2013.01); *F23R 3/28* (2013.01)
USPC ..... 60/742; 60/740; 60/772; 239/398

(58) Field of Classification Search
CPC ..... F23D 14/24; F23R 3/04; F23R 3/28; F23R 3/286
USPC ..... 60/737, 740, 742, 772; 239/398; 431/354
See application file for complete search history.

(56) References Cited

U.S. PATENT DOCUMENTS 4,030,875 A 6/1977 Grondahl et al.
4,063,872 A 12/1977 Lambiris
4,445,339 A 5/1984 Davis, Jr. et al.
4,845,952 A 7/1989 Beebe
4,854,127 A 8/1989 Vinson et al.
4,966,001 A 10/1990 Beebe
5,117,636 A 6/1992 Bechtel, II et al.
5,165,241 A 11/1992 Joshi et al.
5,199,265 A 4/1993 Borkowicz
5,203,796 A 4/1993 Washam et al.
5,251,447 A 10/1993 Joshi et al.
5,253,478 A 10/1993 Thibault, Jr. et al.
5,285,631 A 2/1994 Bechtel, II et al.
5,295,352 A 3/1994 Beebe et al.
5,309,710 A 5/1994 Corr, II
5,323,604 A 6/1994 Ekstedt et al.
5,359,847 A 11/1994 Pillsbury et al.
5,479,782 A 1/1996 Parker et al.
5,511,375 A 4/1996 Joshi et al.
5,590,529 A 1/1997 Joshi et al.
5,596,873 A 1/1997 Joshi et al.
5,613,363 A 3/1997 Joshi et al.
5,638,682 A 6/1997 Joshi et al.

(Continued)

OTHER PUBLICATIONS

Search Report and Written Opinion from EP Application No. 12188889.5 dated Feb. 6, 2013.

*Primary Examiner* — J. Gregory Pickett
(74) *Attorney, Agent, or Firm* — Nixon & Vanderhye P.C.

(57) ABSTRACT

A fuel nozzle assembly has been conceived for a combustor in a gas turbine including a first passage and fourth passage connectable to a source of gaseous fuel, a second passage connectable to a source of a gaseous oxidizer, and a third passage coupled to a source of a diluent gas, wherein the first passage is a center passage and is configured to discharge gaseous fuel from nozzles at a discharge end of the center passage, the second passage is configured to discharge the gaseous oxidizer through nozzles adjacent to the nozzles for the center passage, the third passage discharges a diluent gas through nozzles adjacent to the nozzles for the second passage, and the fourth passage is configured to discharges the gaseous fuel downstream of the discharge location for the first, second and third passages.

18 Claims, 5 Drawing Sheets

(56) References Cited

U.S. PATENT DOCUMENTS

| | | | | |
|---|---|---|---|---|
| 5,675,971 | A | 10/1997 | Angel et al. | |
| 5,680,766 | A | 10/1997 | Joshi et al. | |
| 5,778,676 | A | 7/1998 | Joshi et al. | |
| 5,833,141 | A | 11/1998 | Bechtel, II et al. | |
| 5,865,024 | A | 2/1999 | Kress et al. | |
| 6,050,082 | A | 4/2000 | Leonard et al. | |
| 6,089,025 | A | 7/2000 | Tekriwal et al. | |
| 6,123,273 | A | 9/2000 | Loprinzo et al. | |
| 6,141,967 | A | 11/2000 | Angel et al. | |
| 6,195,607 | B1 | 2/2001 | Rajamani et al. | |
| 6,381,964 | B1 | 5/2002 | Pritchard, Jr. et al. | |
| 6,438,959 | B1 | 8/2002 | Dean et al. | |
| 6,438,961 | B2 | 8/2002 | Tuthill et al. | |
| 6,449,953 | B1 | 9/2002 | Hook, Jr. et al. | |
| 6,536,206 | B2 | 3/2003 | Hook, Jr. et al. | |
| 6,735,949 | B1 | 5/2004 | Haynes et al. | |
| 6,832,481 | B2 | 12/2004 | Koenig et al. | |
| 6,951,108 | B2 | 10/2005 | Burrus | |
| 6,983,600 | B1 | 1/2006 | Dinu et al. | |
| 6,993,916 | B2 | 2/2006 | Johnson et al. | |
| 7,003,958 | B2 | 2/2006 | Dinu et al. | |
| 7,007,478 | B2 | 3/2006 | Dinu | |
| 7,093,438 | B2 | 8/2006 | Dinu et al. | |
| 7,284,378 | B2 | 10/2007 | Amond, III et al. | |
| 7,581,396 | B2 | 9/2009 | Hsieh et al. | |
| 2007/0003897 | A1* | 1/2007 | Koizumi et al. | 431/354 |
| 2009/0241508 | A1 | 10/2009 | Davis, Jr. et al. | |
| 2010/0058767 | A1 | 3/2010 | Simons et al. | |
| 2010/0089020 | A1 | 4/2010 | Barton et al. | |
| 2010/0101204 | A1 | 4/2010 | Berry et al. | |
| 2010/0170253 | A1* | 7/2010 | Berry et al. | 60/742 |
| 2010/0281869 | A1* | 11/2010 | Hadley et al. | 239/398 |
| 2010/0300102 | A1* | 12/2010 | Bathina et al. | 60/737 |
| 2011/0162373 | A1 | 7/2011 | Intile et al. | |
| 2011/0162379 | A1 | 7/2011 | Baruah et al. | |

* cited by examiner

DIFFUSION NOZZLES FOR LOW-OXYGEN FUEL NOZZLE ASSEMBLY AND METHOD

BACKGROUND OF THE INVENTION

The invention relates generally to fuel nozzles for combustors and, specifically, to the introduction of fuel and air from a fuel nozzle into a combustion zone of the combustor for a gas turbine.

Gas turbines that have combustors operating at low oxygen conditions are generally referred to as low oxygen gas turbines. These gas turbines may be used in carbon capture arrangements and in arrangements having high exhaust gas recirculation.

The working fluid in a gas turbine is generally the gas that is pressurized in the compressor, heated in the combustor and driving the turbine. The working fluid in a low oxygen gas turbine typically has a reduced concentration of oxygen as compared to the oxygen concentration in normal atmospheric air. For example, the working fluid may be a combination of exhaust gas from the gas turbine and atmospheric air. Due to the presence of exhaust gases, the working fluid has a relatively low oxygen content as compared to atmospheric air.

Oxygen is needed for combustion in the combustor. A working fluid having a reduced oxygen concentration requires a combustor configured to provide complete and stable combustion in reduced oxygen conditions. To provide sufficient oxygen for combustion, an oxidizer gas may be injected with the fuel into the combustor. The oxidizer gas may be atmospheric air, pure oxygen, a mixture of oxygen and carbon dioxide (CO2) or another oxygen rich gas.

BRIEF DESCRIPTION OF THE INVENTION

A fuel nozzle assembly has been developed that is configured for low oxygen gas turbines. The fuel nozzle assembly provides high efficiency combustion and substantially complete combustion within a short residence period. The fuel nozzle assembly provides strong flame stability.

The fuel nozzle assembly includes four coaxial passages for gaseous fuel, an oxidizer gas and a diluent gas. The four passages include center and outer passages for the fuel, a second annular passage for the oxidizer gas and a third annular passage for the diluent gas, wherein the fourth passage is the outermost passage. The discharge ends of the center fuel passage and the passages for the oxidizer and diluent gases are generally aligned and housed within a cavity, e.g., conical housing, which is open to the combustion chamber of the combustor. The outer fuel passage may be aligned with the discharge end of the cavity.

With respect to the inner three passages, the discharge ends of each of these passages includes nozzles, e.g., short narrow channels, that direct the gas from the passage into a cavity at the end of the fuel nozzle assembly. The gases mix in the cavity. The nozzles of the center passage and third passage may be oriented to induce a clock-wise swirl flow to the fuel and diluent gases, respectively. The nozzles of the second passage induce a counter-clockwise swirl to the oxidizer gas. The nozzles of the second passage are arranged in a ring between the nozzles of the center passage and a ring of the nozzles of the third passage, The counter rotating swirling gas flows promotes rapid mixing of the fuel, oxidizer and diluent gases. The addition of the diluent gas tends to retard combustion until the gas mixture is downstream of the fuel nozzle assembly.

The combustion provided by the fuel nozzle assembly may be controlled by regulating the rate of gases flowing from each of the passages. For example, the amount of the diluent gas may be adjusted to ensure that combustion is delayed until the mixture of gases is beyond the end of the fuel nozzle assembly. Further, the combustion may be controlled by adjustment of a fuel split, e.g., ratio, between gaseous fuel being discharged from the center passage and from the fourth passage. This control may include regulating the combustion reaction rates, the flame anchoring location and flame temperature.

A fuel nozzle assembly has been conceived for a combustor in a gas turbine comprising: a first passage connectable to a source of gaseous fuel, a second passage connectable to a source of a gaseous oxidizer, a third passage coupled to a source of a diluent gas, and a fourth passage also connectable to the source of gaseous fuel, wherein the first passage is a center passage and is configured to discharge gaseous fuel from nozzles at a discharge end of the center passage, the second passage is configured to discharge the gaseous oxidizer through nozzles adjacent to the nozzles for the center passage and the third passage is configured to discharge a diluent gas through nozzles adjacent to the nozzles for the second passage. The first, second and third passages may be coaxial to an axis of the center passage, the nozzles for the third passage form an annular array around the axis, and the nozzles for the second passage form an annular array around the axis and between the annular array for the third passage and the nozzles for the center passage. The discharge end of the fourth passage may be aligned axially with a downstream end of a cavity at the end of the fuel nozzle assembly, wherein the cavity houses the outlet ends of the nozzles for the first three passages.

In the fuel nozzle assembly, the nozzles for the first passage comprise narrow passages each having a radially outwardly oriented pitch angle and a positive yaw angle in a range of 40 to 60 degrees, and wherein the nozzle of the second and third passages each a radially inwardly oriented pitch angle and a yaw angle of 5 to 16 degrees, wherein the yaw angle for the nozzles of the third passage is positive and the yaw angle for the nozzles of the second passage is negative.

The source of the diluent gas may be a compressor for the gas turbine and the diluent gas includes a working fluid flowing through the gas turbine. The source of the oxidizer gas is the atmospheric and the oxider gas includes atmospheric air.

A combustor has been conceived for a gas turbine having a reduced oxygen working fluid, wherein the combustor comprises: a combustion chamber having a downstream end through which combustion gases flow towards a turbine of the gas turbine, and an inlet end opposite to the downstream end; fuel nozzle assembly, at the upstream end of the combustor, which includes first and fourth passages connectable to a source of gaseous fuel, a second passage connectable to a source of a gaseous oxidizer and a third passage coupled to a source of a diluent gas, wherein the first passage is a center passage and is configured to discharge gaseous fuel from nozzles at a discharge end of the center passage, the second passage is configured to discharge the gaseous oxidizer through nozzles adjacent to the nozzles for the center passage, the third passage is configured to discharge a diluent gas through nozzles adjacent to the nozzles for the second passage, and the fourth passage configured to discharge gaseous fuel down stream of the discharges by the first, second and third passages.

A method has been conceived to produce combustion gases in a combustor for a low oxygen gas turbine comprising, wherein the combustor includes a fuel nozzle assembly and a combustion chamber, the method includes: discharging a fuel from a center passage extending through the fuel nozzle assembly and a fourth passage, wherein the fuel is discharged from the center passage to a cavity at the end of the fuel nozzle assembly as a swirling flow rotating in a first rotational direction; discharging an oxidizer into the chamber from a second passage including a discharge end adjacent a discharge end of the first passage, wherein the oxidizer is discharged into the cavity as a swirling flow rotating in a second rotational direction which is opposite to the first rotational direction; discharging a diluent from a third passage including a discharge end adjacent the discharge end of the second passage, wherein the diluent is discharged into the cavity as a swirling flow rotating in the first rotational direction; retarding combustion of the fuel and oxidizer by the discharge of the diluent into the cavity; discharging the fuel from the fourth passage downstream of an open end of the cavity, and initiating combustion of the fuel and oxidizer in the combustion chamber and downstream of the open end of the cavity.

BRIEF DESCRIPTION OF THE DRAWINGS

The structure, operation and features of the invention are further described below and illustrated in the accompanying drawings which are.

DETAILED DESCRIPTION OF THE INVENTION

Figure 1:
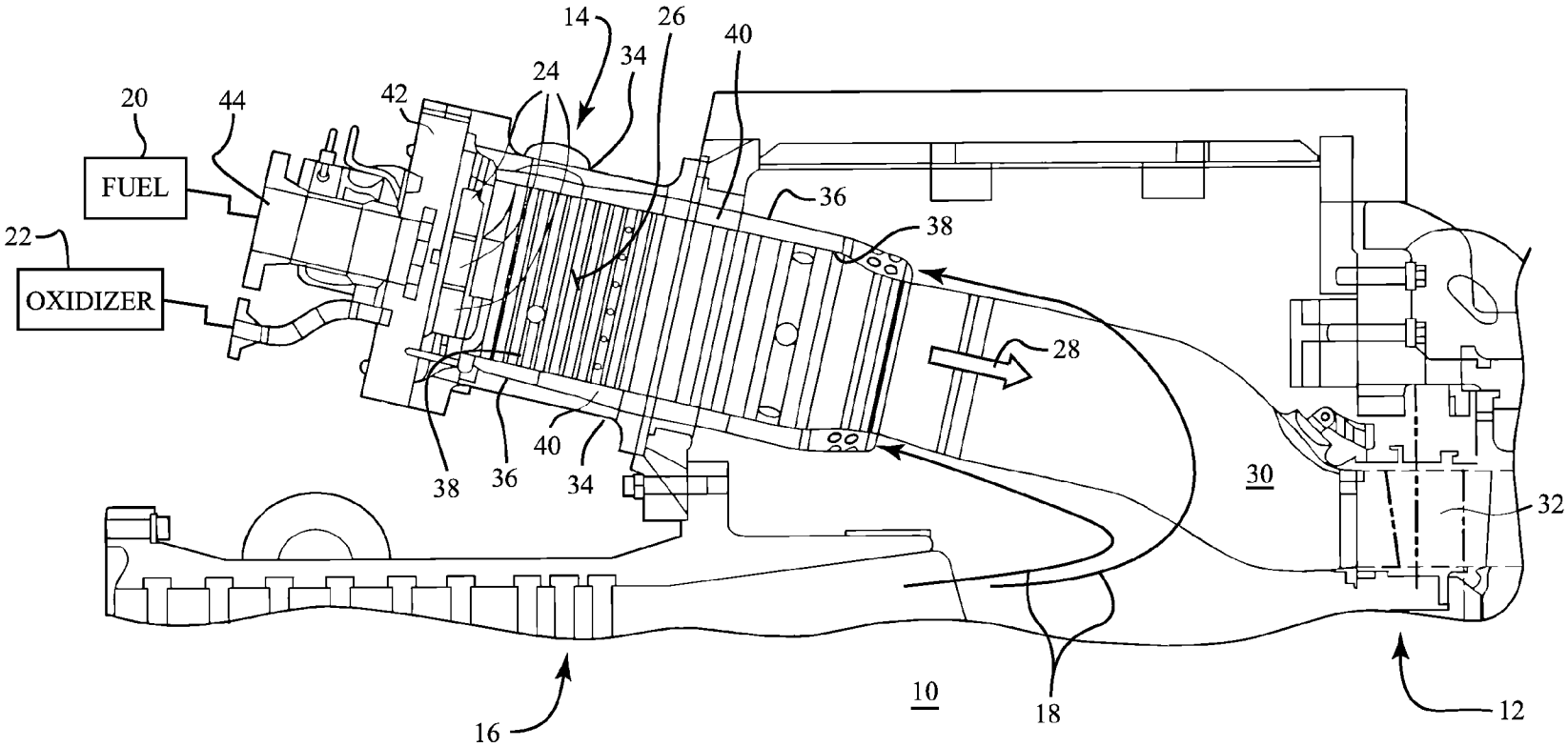
FIG. 1 is a cross-sectional diagram of a conventional combustor in an industrial gas turbine.

FIG. 1 is side view, showing in partial cross section, a low oxygen gas turbine engine 10 including an axial turbine 12, an annular array of combustors 14, and an axial compressor 16. A working fluid, e.g., a low oxygen gas, is pressurized by the compressor and ducted to each of the combustors 14. A first end of each combustor is coupled to manifolds providing gaseous fuel 20 and an oxidizer gas 22, e.g., atmospheric air. The fuel, oxidizer and working fluid flow through fuel nozzle assemblies 24 and combust in a combustion chamber 26 in the combustor. Combustion gases 28 flow from the combustion chamber through a duct 30 to drive turbine buckets (blades) 32 of the turbine and turn a shaft of the gas turbine. The rotation of the shaft drives the compressor 16 and transfers useful output power from the gas turbine.

Each combustor may have an outer generally cylindrical casing 34 which houses a cylindrical liner 36 and cylindrical flow sleeve 38, each of which are coaxial to the other. The combustion chamber 26 is within and defined by the flow sleeve 38. An annular duct 40 for the working fluid 18 is between the flow sleeve and the liner 36, which surrounds the sleeve. As the working fluid passes through the duct 40, it 18 cools the combustor and flows through openings in the flow sleeve into the combustion chamber where the working mixes with the combustion gases flowing to the duct 40.

An end cover 42 caps each combustor at an end opposite to the duct 40. The end cover supports couplings 44 to manifolds that provide the gaseous fuel 20 and oxidizer gas 22 to each combustor. The end cover 42 includes passages which direct the fuel 20 and oxidizer gas 22 to the fuel nozzle assemblies 24.

Figure 2:
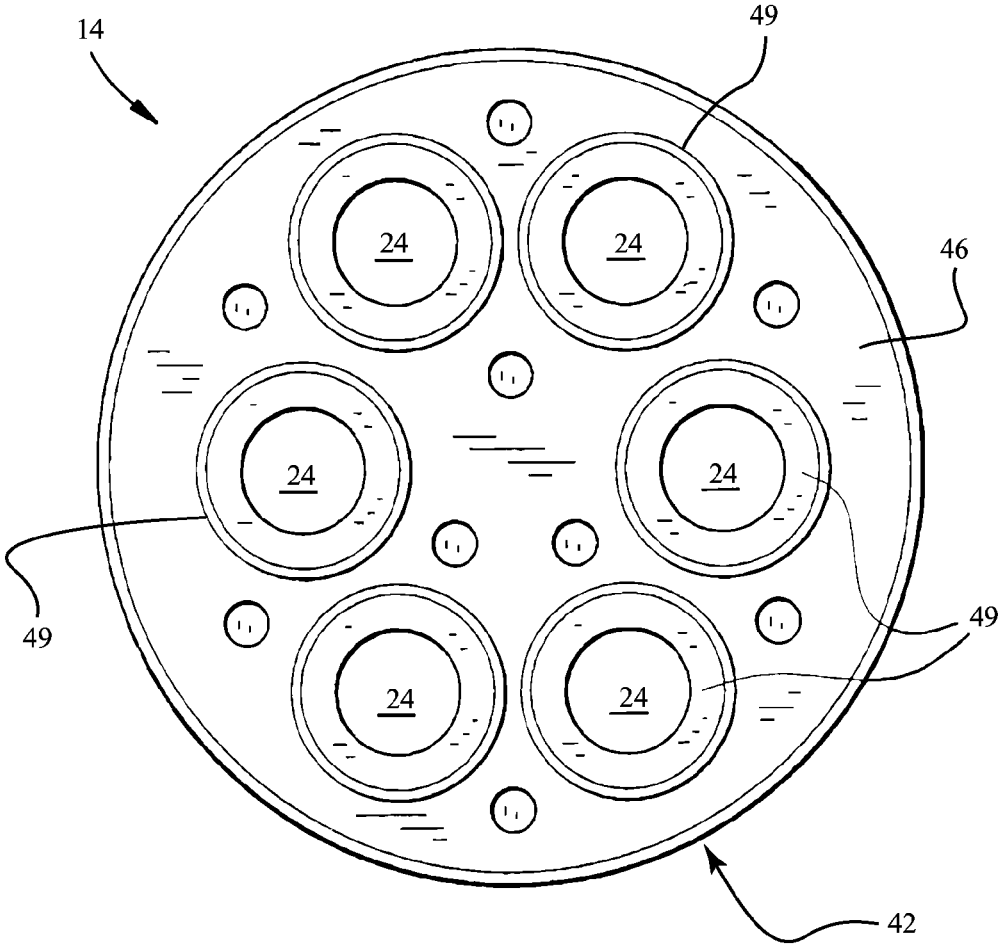
FIG. 2 is a schematic diagram of the interior of the combustor looking towards the end cover and showing a front view of the fuel nozzle assemblies.

FIG. 2 is a schematic diagram of the interior of the combustor 14 looking towards the end cover and showing a front view of the fuel nozzle assemblies 24. A circular baffle plate 46 is offset by a gap 48 (FIG. 3) from the inside surface of the end cover. The baffle plate has circular openings 49 through which extend the fuel nozzles. The working fluid, also referred to as diluent gas, flows behind the baffle plate and through the gap 48 to the fuel nozzle assemblies 24. The fuel nozzles are oriented to discharge fuel, gas and working fluid into the combustion chamber 26 (FIG. 1). The arrangement of fuel nozzle assemblies 24 on the end cover may be an array, as shown in FIG. 2, an array with a center fuel nozzle assembly, a single fuel nozzle assembly or another arrangement of fuel nozzle assemblies.

Figure 3:
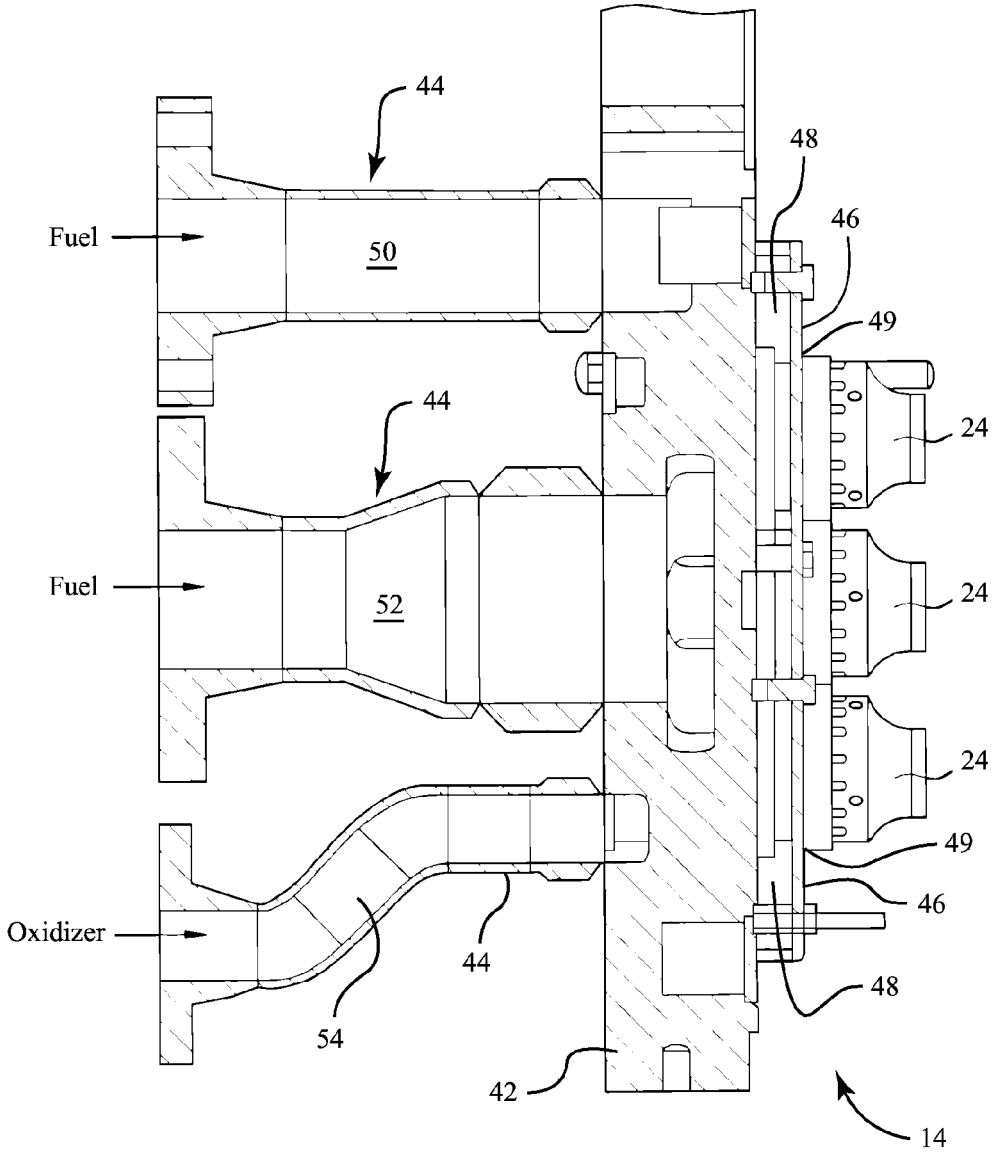
FIG. 3 is a cross-sectional view of a portion of the combustor wherein the cross-section is along an axis of the combustor.

FIG. 3 is a cross-sectional side view of a portion of the combustor 14 to show the couplings 44 for the fuel and oxidizer manifolds, an end cover 42, baffle plate 46 and fuel nozzle assemblies 24. Fuel flows through passages 50, 52 of the coupling 44, through the end cap and to fuel nozzle assemblies 24. Similarly, oxidizer gas flows through a passage 54 of the couplings, through the end cap and to the fuel nozzle assemblies. The oxidizer gas and fuel may flow through separate passages. The fuel and oxidizer may not mix until there are discharged from the fuel nozzle assemblies.

Figure 4:
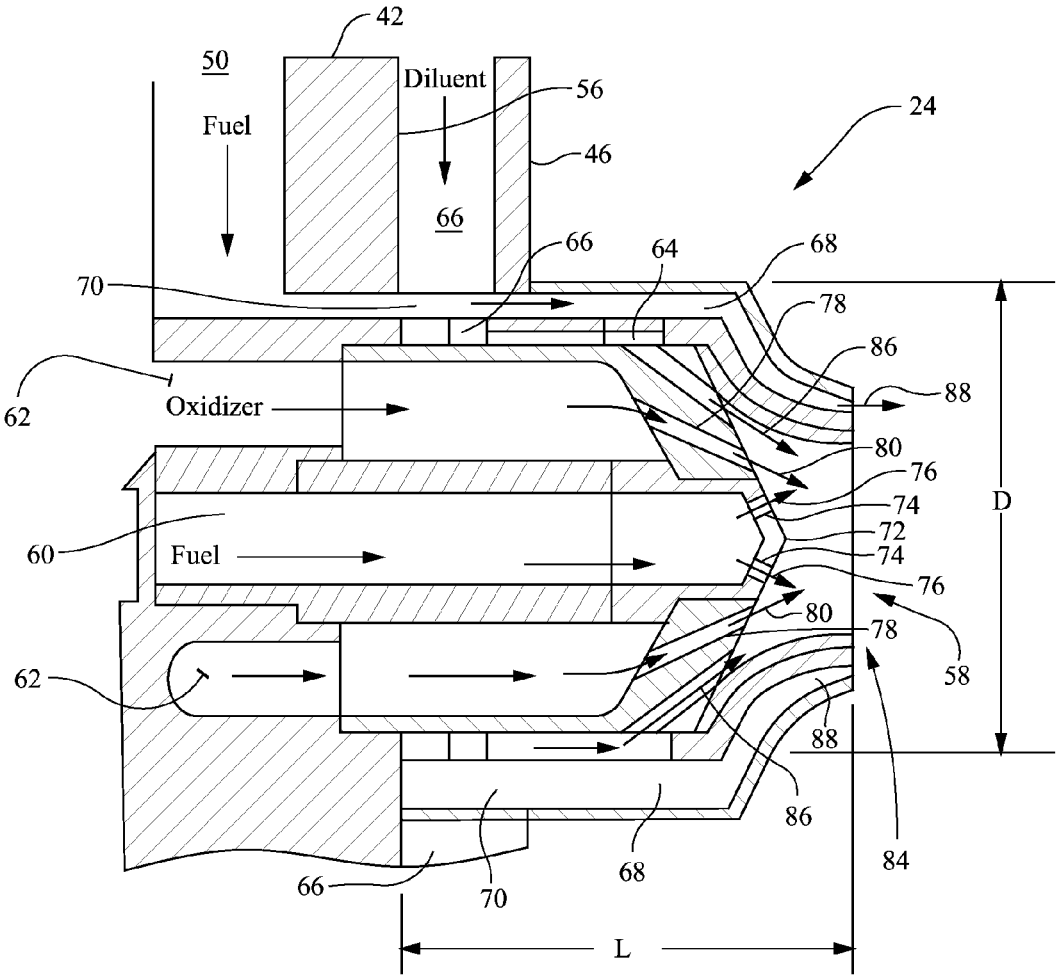
FIG. 4 is a cross-sectional view of a fuel nozzle assembly 24, which may include concentric passages for the fuel, oxidizer and diluent gases.

FIG. 4 is a cross-sectional view of a fuel nozzle assembly 24, which may include concentric passages for the fuel, oxidizer and diluent gases. The passages may include a center passage 60 for fuel and that is in fluid communication with the fuel passage 52 of the manifold 44. A second passage 62 is adjacent the center passage, is for the oxidizer gas, such as atmospheric air, and is in fluid communication with the oxidizer passage 54 in the manifold. The second passage may be annular and concentric with the center passage. The second passage is between a third passage 64 and the center passage. The third passage 64 is for diluent, e.g., the low-oxygen working fluid, which flows in a gap 66 between the baffle plate 46 and the inside surface 56 of the end cap. A fourth passage 68 is for the gaseous fuel which is received from the passage 50 of the manifold 44. The fourth passage is radially outward of the other passage and near the periphery of the fuel nozzle assembly. The fourth passage 68 may include tubular channels 70 which are parallel to the axis 72 of the fuel nozzle assembly, extend through the gap 66 and allow diluent to flow over the outer surface of the channels towards the third passage 64.

The portion of the fuel nozzle assembly 24 near the outlet 58 includes nozzles for the passages that swirl the gases being discharged from the passages. The discharge end of the center passage 60 includes nozzles 74 (narrow passages in the end wall) which may be arranged in a circular array and diverge along a cone angle formed with respect to the axis 72 of the passage. The apex for the cone angle is upstream of the nozzles 74 such that the gas fuel is discharged in a pitch angle, e.g., 10 to 45 degrees, that is both downstream of the nozzles and radially outward of the axis 72. In addition to the pitch angle, the nozzles 74 may have a yaw angle of 40 to 60 degrees, for example, with respect to the axis 72. The yaw angle causes the fuel being discharged from the nozzles (see arrows 76) to swirl about the axis 72 in a clockwise rotational direction. The center passage may also include a pilot nozzle to discharge fuel for a combustor startup condition.

The nozzles 78 at the discharge end of the second passage 62 cause the oxidizer gas to (see arrows 80) flow directly into the expanding conical swirling flow of the fuel (arrow 76).

The nozzles 78 cause the oxidizer gas to swirl in a counter-clockwise direction, which is opposite to the swirl of the gas discharged from the center passage 60. The colliding flows and opposite swirling flows of the oxidizer and fuel causes a rapid and vigorous mixing which promotes rapid and complete combustion of the fuel.

Nozzles are arranged in an annular array at the discharge end of each of the annular passages and the center passage. To swirl the flows, the nozzles for the middle and inner annular passages are oriented at oblique angles with respect to the axis of the passage. These nozzles for the middle and inner annular passages cause the working fluid and oxidizer to swirl in opposite rotational directions as the gases are discharged from the passages into a combustion zone. Similarly, the discharge nozzles for the center passage may be angled with respect to the axis. In contrast, the nozzles for the outer passage may be aligned with the axis and not induce a swirl in the flow of fuel being discharged by that passage.

The opposite rotating swirls cause shearing between the working fluid and oxidizer flows which promotes rapid mixing of these flows as well as the gaseous fuel flows which are adjacent to the swirling flows. Mixing is also promoted by the fuel flowing from the angled nozzles in the center passage and directly into the swirling flows of the oxidizer and working fluid.

The nozzles 78 of the second passage may be arranged in a circular array and converge along a pitch (cone) angle of, for example, 20 to 26 degrees with respect to the axis 72. The apex of the cone angle for the nozzles 78 is downstream of the nozzles. In addition to the pitch due to the cone angle, the nozzles 78 may have a yaw angle of 5 to 16 degrees, for example, with respect to the axis 72. The yaw angle for the nozzles 78 is opposite, e.g., negative, to the yaw angle, e.g., positive, for the center passages. The pitch and yaw angles cause the nozzles 78 to direct the oxidizer gas downstream and radially inward towards the fuel gas being discharged from the nozzles 74 of the center passage 60.

The third passage 70 has a circular array of nozzles 82 at a discharge end that passage for injecting the diluent, e.g., working fluid, into the swirling mixture of fuel and oxidizer gases. The injection of the low-oxygen working fluid delays and retards combustion until the fuel and oxidizer are downstream of the cavity 84, e.g., a radially outwardly expanding conical section, at the end of the fuel nozzle assembly.

The nozzles 82 of the third passage may be arranged in a circular array and aligned on a pitch (cone) angle of 30 to 36 degrees, for example. The nozzles 82 converge such that the pitch of the cone angle is radially inward towards the axis 72 of the fuel nozzle assembly. The nozzles 82 may also be arranged to have a positive yaw angle of 5 to 16 degrees to induce a clockwise swirl to the working fluid as it flows into the mixture of fuel and oxidizer gases. The swirling and converging flow (arrow 86) of the working fluid creates shear flows and promotes rapid mixing of the working fluid, oxidizer and fuel gases. The vigorous and rapid mixing allows combustion to occur rapidly as the mixture flows past the end of the cavity 84. Further, the rapid combustion results in high flame temperatures which promotes efficient combustion and good flame stability.

The nozzles 88 discharging fuel gas from the fourth passage 68 may be aligned with the end of the cavity 84 and oriented to be parallel to the axis 72 in pitch and yaw. The fuel may be discharged from the nozzles 88 in an axial direction and without induced swirl.

The fuel gas discharged by the nozzles 88 is combusted downstream of the cavity 84. The fuel flow from the nozzles 88 is staged, in an axial direction, with respect to the fuel being discharged from the center passage 60. The axial flow and velocity of the fuel gas discharged by the nozzles 88 may be used to move the combustion downstream from the end of the cavity 84 and thereby reduce the risk of damage to the fuel nozzle due to flame anchoring within the cavity 84. Further, the rate of fuel flowing through the passages 50, 68 and through the nozzles 8 may be adjusted to, for example, reduce emissions of nitrous oxides (NOx).

The fuel nozzle assembly 24 may be generally cylindrical and short, as compared to fuel nozzles having tubular fuel nozzles such as shown in US Patent Application Publication 2009/0241508. The diameter (D) of the fuel nozzle assembly may be substantially equal to the length (L) of the portion of the fuel nozzle assembly extending outward from the inner surface 56 of the end cover 42. Further, the outlet 58 of the fuel nozzle assembly 24 may be aligned with an axial end of the combustion sleeve 38 nearest the end cover.

Figure 5:
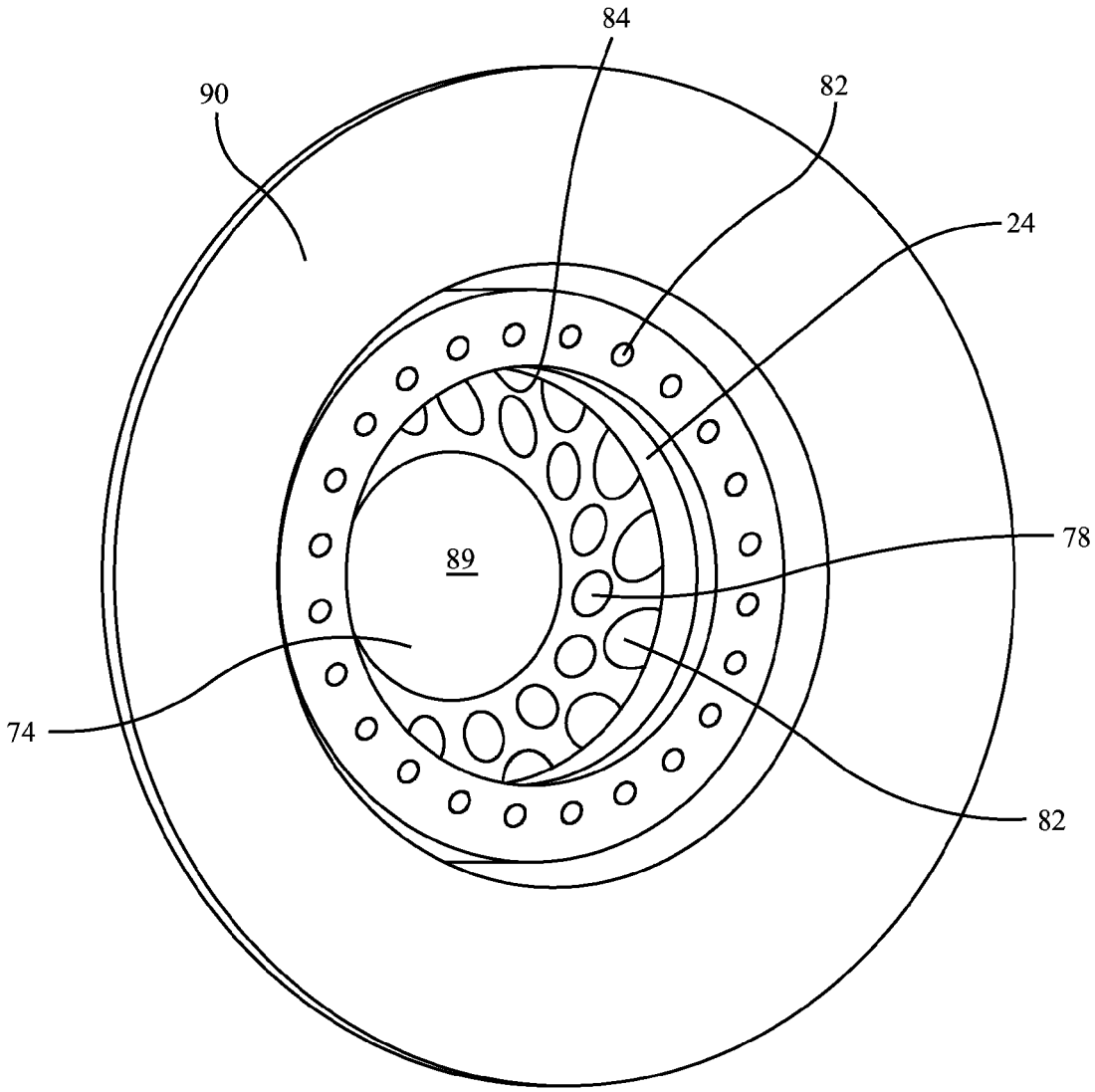
FIG. 5 is a perspective view of the discharge end of a fuel nozzle assembly.

FIG. 5 is a perspective view of the discharge end of a fuel nozzle assembly 24. The discharge end 89 of the center passage is at the tip end of a cone which extends to the discharge ends of the second and third passages. Along the slope of the cone are the nozzles 74 of the center passage, the circular array of nozzles 78 of the second passage and the circular array of nozzles 82 of the third passage. The outlets of each of the nozzles 74, 78 and 82 are within the recess of the cavity 84. The nozzles 82 for the third passage extend in a ring around the outer rim of the cavity. The rim of the cavity and the discharge end of the fuel nozzle are seated in a recess 90 at an end of the combustor sleeve.

The fuel assembly 24 is configured to provide efficient and complete combustion, with good flame stability and operate at or near stoichiometric combustion conditions. By mixing diluent gas with fuel and oxidizer gases within the cavity 84, combustion is delayed until the mixture is downstream of the cavity and fuel nozzle assembly. The counter rotating swirls of the fuel, oxidizer and diluent gases promotes vigorous and complete gas mixing within the cavity such that combustion occurs efficiently and completely.

The flow rate of the diluent gas may be adjusted to promote combustion at a desired position downstream of the fuel nozzle assembly. Similarly, the flow rate of the fuel being discharged from the fourth passage 68 may be adjusted to promote efficient and complete combustion, good flame stability and low NOx emissions.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel nozzle assembly for a combustor in a gas turbine comprising:

a first passage and a fourth passage each connectable to a source of gaseous fuel, a second passage connectable to a source of a gaseous oxidizer and a third passage coupled to a source of a diluent gas;

wherein the first passage is a center passage and is configured to discharge the gaseous fuel from nozzles at a discharge end of the center passage wherein the discharge end is within a cavity of the fuel nozzle assembly, the second passage is configured to discharge the gaseous oxidizer through nozzles adjacent to the nozzles for the center passage and within the cavity, the third passage is configured to discharge a diluent gas through nozzles adjacent to the nozzles for the second passage and within the cavity, and the fourth passage is configured to discharge the gaseous fuel downstream of an open end of the cavity.

2. The fuel nozzle assembly as in claim 1 wherein the second, third and fourth passages are coaxial to an axis of the center passage, the nozzles for the third passage form an annular array around the axis, the nozzles for the second passage form an annular array around the axis and between the annular array for the third passage and the nozzles for the center passage, and the fourth passage is configured to discharge the gaseous fuel through nozzles which form an annular array around the open end of the cavity.

3. The fuel nozzle assembly as in claim 1 a discharge end of the fourth passage is aligned axially with a downstream end of the fuel nozzle assembly.

4. The fuel nozzle assembly as in claim 1 wherein the nozzles for the first passage comprise narrow passages each having a radially outwardly oriented pitch angle and a positive yaw angle in a range of 40 to 60 degrees, and wherein the nozzle of the second and third passages each having a radially inwardly oriented pitch angle and a yaw angle of 5 to 16 degrees, wherein the yaw angle for the nozzles of the third passage is positive and the yaw angle for the nozzles of the second passage is negative.

5. The fuel nozzle assembly as in claim 1 wherein the source of the diluent gas is a compressor for the gas turbine and the diluent gas includes a working fluid flowing through the gas turbine.

6. The fuel nozzle assembly as in claim 1 wherein the source of the oxidizer gas is the atmosphere and the oxidizer gas includes atmospheric air.

7. A combustor for a gas turbine having a reduced oxygen working fluid, wherein the combustor comprises:

a combustion chamber having a downstream end through which combustion gases flow towards a turbine of the gas turbine, and an inlet end opposite to the downstream end;

fuel nozzle assembly, at the upstream end of the combustor, which includes a center passage and fourth passage connectable to a source of gaseous fuel, a second passage connectable to a source of a gaseous oxidizer and a third passage coupled to a source of a diluent gas, wherein the center passage is configured to discharge the gaseous fuel from nozzles at a discharge end of the center passage and into a cavity within the fuel nozzle assembly, the second passage is configured to discharge the gaseous oxidizer into the cavity through nozzles adjacent to the nozzles for the center passage, the third passage is configured to discharge a diluent gas into the cavity through nozzles adjacent to the nozzles for the second passage and the fourth passage is configured to discharge the gaseous fuel downstream of the cavity.

8. The combustor fuel nozzle assembly as in claim 7 wherein the second, third and fourth passages are coaxial to an axis of the center passage, the nozzles for the third passage form an annular array around the axis, the nozzles for the second passage form an annular array around the axis and between the annular array for the third passage and the nozzles for the center passage, and the fourth passage is configured to discharge the gaseous fuel through nozzles arranged as an annular array around a downstream open end of the cavity.

9. The combustor as in claim 7 wherein a discharge end of the fourth passage is aligned axially with a downstream of the fuel nozzle assembly.

10. The combustor as in claim 7 wherein the nozzles for the first passage comprise narrow passages each having a radially outwardly oriented pitch angle and a positive yaw angle in a range of 40 to 60 degrees, and wherein the nozzle of the second and third passages each a radially inwardly oriented pitch angle and a yaw angle of 5 to 16 degrees, wherein the yaw angle for the nozzles of the third passage is positive and the yaw angle for the nozzles of the second passage is negative.

11. The combustor as in claim 7 wherein the source of the diluent gas is a compressor for the gas turbine and the diluent gas includes a working fluid flowing through the gas turbine.

12. The combustor as in claim 7 wherein the source of the oxidizer gas is the atmosphere and the oxidizer gas includes atmospheric air.

13. A method to produce combustion gases in a combustor for a low oxygen gas turbine comprising, wherein the combustor includes a fuel nozzle assembly and a combustion chamber, the method includes:

discharging a fuel from a center passage and from a fourth passage each extending through the fuel nozzle assembly, wherein the fuel is discharged from the center passage and into a cavity at the end of the fuel nozzle assembly as a swirling flow rotating in a first rotational direction;

discharging an oxidizer into the chamber from a second passage adjacent the center passage, wherein a discharge end of the second passage is adjacent a discharge end of the center passage, and wherein the oxidizer is discharged into the cavity as a swirling flow rotating in a second rotational direction which is opposite to the first rotational direction;

discharging a diluent from a third passage adjacent the second passage, wherein a discharge end of the third passage is adjacent the discharge end of the second passage, and wherein the diluent is discharged into the cavity as a swirling flow rotating in the first rotational direction;

retarding combustion of the fuel and oxidizer by the discharge of the diluent into the cavity;

discharging the fuel from a discharge end of the fourth passage adjacent a downstream, open end of the cavity, and initiating combustion of the fuel and oxidizer in the combustion chamber and downstream of the open end of the cavity.

14. The method of claim 13 wherein the fuel is discharged from nozzles in the discharge end of the fourth passage which extend around the open end of the cavity.

15. The method of claim 13 wherein the diluent is compressed working fluid from the gas turbine and discharged by a compressor of the gas turbine, wherein the working fluid includes exhaust gases from the gas turbine when discharged by the compressor.

16. The method of claim 13 wherein the second and third passages are coaxial to an axis of the center passage, and the oxidizer and diluent are each discharged in separate conical swirling flows extending radially inward towards the fuel being discharged by the center passage.

17. The method of claim 13 wherein the oxidizer and diluent are discharged from second and third passages, respectively, at yaw angles in a range of 5 to 16 degrees to induce the swirling flows.

18. The method of claim 13 wherein the source of the oxidizer gas is the atmosphere and the oxidizer gas includes the atmospheric air.

* * * * *

UNITED STATES PATENT AND TRADEMARK OFFICE

CERTIFICATE OF CORRECTION

PATENT NO. : 8,955,329 B2
APPLICATION NO. : 13/278960
DATED : February 17, 2015
INVENTOR(S) : Popovic et al.

It is certified that error appears in the above-identified patent and that said Letters Patent is hereby corrected as shown below:

In the Specification

At column 2, line 40, change “oxider” to --oxidizer--

Signed and Sealed this
Seventh Day of July, 2015

Michelle K. Lee

Michelle K. Lee
*Director of the United States Patent and Trademark Office*